US010844857B2

(12) United States Patent
Collins

(10) Patent No.: US 10,844,857 B2
(45) Date of Patent: Nov. 24, 2020

(54) COMPRESSOR SYSTEM WITH PURGE GAS SYSTEM

(71) Applicant: Ingersoll-Rand Company, Davidson, NC (US)

(72) Inventor: James Christopher Collins, Moorseville, NC (US)

(73) Assignee: Ingersoll-Rand Industrial U.S., Inc., Davidson, NC (US)

( * ) Notice: Subject to any disclaimer, the term of this patent is extended or adjusted under 35 U.S.C. 154(b) by 108 days.

(21) Appl. No.: 16/012,305

(22) Filed: Jun. 19, 2018

(65) Prior Publication Data

US 2019/0383290 A1 Dec. 19, 2019

(51) Int. Cl.

| | |
|---|---|
| ***F04C 18/16*** | (2006.01) |
| ***F04C 29/00*** | (2006.01) |
| ***F04C 29/02*** | (2006.01) |
| ***F04C 15/00*** | (2006.01) |

(52) U.S. Cl.

CPC ..... *F04C 18/16* (2013.01); *F04C 15/0038* (2013.01); *F04C 29/0092* (2013.01); *F04C 29/02* (2013.01); *F04C 2220/12* (2013.01); *F04C 2230/91* (2013.01); *F04C 2240/56* (2013.01); *F04C 2240/605* (2013.01); *F05C 2225/04* (2013.01); *F05C 2251/14* (2013.01); *F05C 2253/12* (2013.01)

(58) Field of Classification Search

CPC .... F04C 15/008; F04C 18/16; F04C 29/0092; F04C 29/02; F04C 29/0014; F04C 2220/12; F04C 2230/91; F04C 2240/56; F04C 2240/605; F05C 2225/04; F05C 2251/14; F05C 2253/12; F16C 33/043; F16C 33/1005; F16C 2206/04

See application file for complete search history.

(56) References Cited

U.S. PATENT DOCUMENTS 4,439,121 A * 3/1984 Shaw ..... F04C 29/02 418/201.1
4,984,974 A * 1/1991 Naya ..... F04C 29/0092 418/87
5,078,580 A * 1/1992 Miller ..... F04B 9/042 417/265

(Continued)

OTHER PUBLICATIONS

Ala' A. Al-Azizi, Osman Eryilmaz, Ali Erdemir, Seong H. Kim, Nano-texture for a Wear-resistant and Near-frictionless Diamond-like Carbon, Science Direct, Carbon 73 (2014), pp. 403-412.

(Continued)

*Primary Examiner* — Patrick Hamo
*Assistant Examiner* — Joseph S. Herrmann
(74) *Attorney, Agent, or Firm* — Taft Stettinius & Hollister LLP

(57) ABSTRACT

A compressor system includes a compressor having a rotor; a bearing supporting the rotor, wherein the bearing is disposed in a bearing cavity; and wherein the bearing has a near frictionless coating; and a purge gas system in fluid communication with the bearing cavity and constructed to purge air from the bearing cavity and supply the bearing cavity with the purge gas during operation of the compressor. The purge gas can be nitrogen and the near frictionless coating can be a near-frictionless diamond-like carbon coating.

21 Claims, 6 Drawing Sheets

(56) References Cited

U.S. PATENT DOCUMENTS

| | | | | |
|---|---|---|---|---|
| 6,506,037 | B1 * | 1/2003 | Bush | F01C 1/16 418/152 |
| 6,548,173 | B2 * | 4/2003 | Erdemir | C23C 16/029 423/445 R |
| 8,277,952 | B2 * | 10/2012 | Sugioka | F04B 27/1063 428/634 |
| 8,518,543 | B2 * | 8/2013 | Kano | C23C 28/044 428/408 |
| 9,488,276 | B2 | 11/2016 | Kennedy et al. | |
| 9,745,662 | B2 * | 8/2017 | Memering | C23C 28/044 |
| 9,759,323 | B2 | 9/2017 | Higuchi et al. | |
| 9,895,651 | B2 * | 2/2018 | Garfinkle | B01D 53/047 |
| 2008/0006357 | A1 | 1/2008 | Wakabayashi et al. | |
| 2008/0038132 | A1 * | 2/2008 | Ihara | F04C 29/0092 418/3 |
| 2016/0341249 | A1 | 11/2016 | Yang et al. | |

OTHER PUBLICATIONS

Ali Erdemir and Christophe Donnet, Tribology of Diamond-like Carbon Films: Recent Progress and Future Prospects, Journal of Physics D: Applied Physics 39 (2006), pp. R311-R327.

* cited by examiner

COMPRESSOR SYSTEM WITH PURGE GAS SYSTEM

TECHNICAL FIELD

The present application relates generally to compressor systems and more particularly, but not exclusively, to compressor systems with purge gas systems.

BACKGROUND

Compressor systems remain an area of interest. Some existing systems have various shortcomings, drawbacks and disadvantages relative to certain applications. For example, in some compressor systems, it may be desirable to prevent oxidation of a component. Accordingly, there remains a need for further contributions in this area of technology.

SUMMARY

One embodiment of the present invention is a unique compressor system.

Another embodiment is a unique method of operating a compressor. Other embodiments include apparatuses, systems, devices, hardware, methods, and combinations for compressor systems. Further embodiments, forms, features, aspects, benefits, and advantages of the present application shall become apparent from the description and figures provided herewith.

BRIEF DESCRIPTION OF THE FIGURES

The description herein makes reference to the accompanying drawings wherein like reference numerals refer to like parts throughout the several views, and wherein.

DETAILED DESCRIPTION OF THE ILLUSTRATIVE EMBODIMENTS

Figure 1:
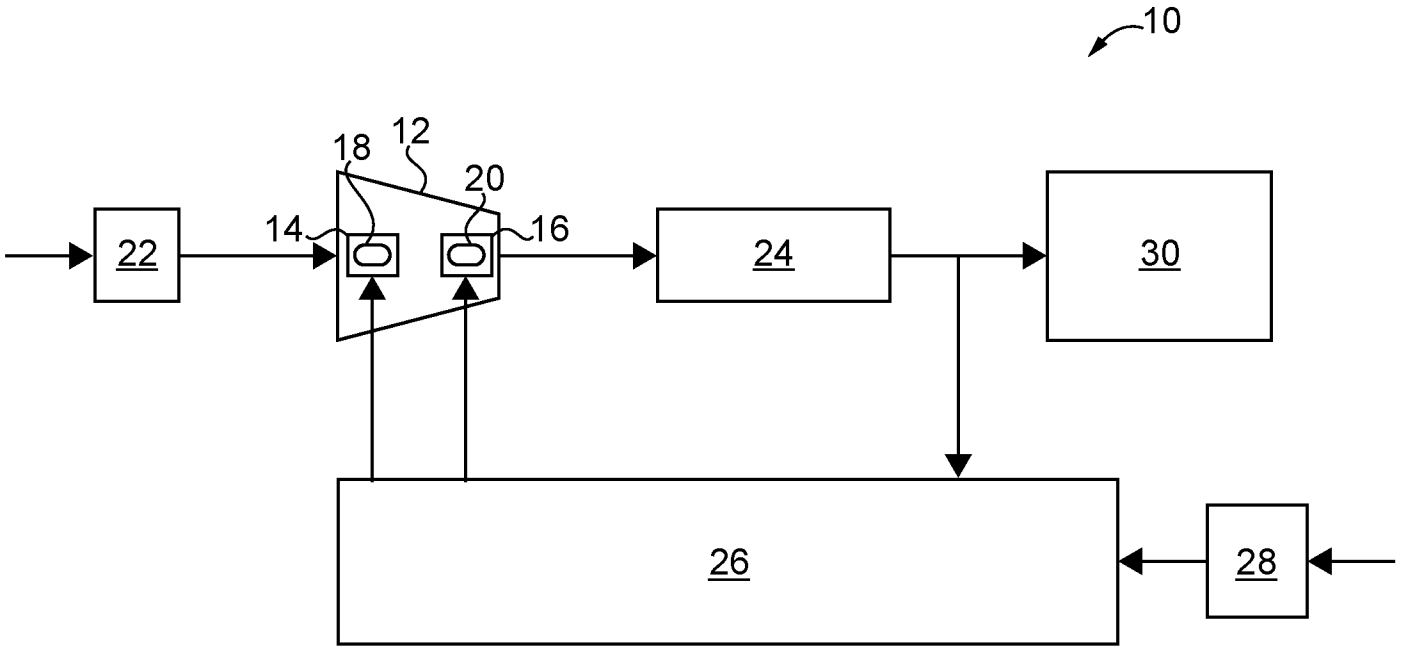
FIG. 1 schematically illustrates some aspects of a non-limiting example of a compressor system in accordance with an embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

Referring to FIG. 1, some aspects of a non-limiting example of a compressor system 10 are illustrated in accordance with an embodiment of the present invention. Compressor system 10 includes a compressor 12. In one form, compressor 12 is a rotary screw compressor. In other embodiments, compressor 12 may be, for example, a centrifugal compressor, a Roots blower, or another type of compressor, pump or blower. Compressor 12 includes a bearing cavity 14 and a bearing cavity 16 disposed at an inlet end and at a discharge end of compressor 12, respectively. In some embodiments, each bearing cavity 14, 16 may be subdivided into a plurality of bearing cavities, which, e.g., may be in fluid communication with each other. Bearing cavity 14 and bearing cavity 16 may be representative of, for example, respective bearing cavities 48 and 58, 60, described in herein below. A bearing system 18 is disposed in bearing cavity 14; and a bearing system 20 is disposed in bearing cavity 16. Compressor system 10 also includes a filter 22; a conditioning system 24; and a purge gas system 26. In some embodiments, purge gas system 26 is coupled to an external compressed gas system, e.g., an external compressed air system 28, which may or may not be considered a part of compressor system 10, depending upon the embodiment. External purge gas system 28 is constructed and operative to supply compressed air to purge gas system 26, e.g., when compressor 12 is not running. External compressed air system 28 may be or include a compressed air storage tank, and/or may be or include a compressor. In some embodiments, external compressed air system 28 may include a conditioning system, e.g., similar to conditioning system 24, for reducing or eliminating water and/or water vapor in the air supplied by external compressed air system 28 to purge gas system 26.

Bearing systems 18, 20, disposed within bearing cavities 14, 16 are constructed and operative to axially (thrust) and radially support the rotors of compressor 12 (not shown in FIG. 1). Air enters compressor system 10 through filter 22. Filter 22 is a particulate filter operative to filter particulate matter from air entering the inlet of compressor 12. Conditioning system 24 is constructed to reduce or eliminate water and/or water vapor from the compressed air discharged by compressor 12, e.g., prior to delivery of the compressed air to a customer device or process 30, and prior to delivery of the compressed air to purge gas system 26. For example, in some embodiments, conditioning system 24 may include a heat exchanger operative to reduce the temperature and dew point of the compressed air, as well as one or more dryers and/or other filters operative to further reduce the moisture content (water and/or water vapor) of the compressed air discharged by compressor 12.

Typical compressors use oil supplied bearings to support the compressor rotor(s) and the loads resulting from the rotor(s) during operation. The combination of radial and axial loads requires an arrangement of multiple bearings, all of which need to be supplied oil to lubricate and remove frictional heat. Doing so creates additional viscous losses, which reduces machine efficiency. In the case of oil-free compressors, to maintain bearing lubrication and compressed air purity, a complex arrangement of seals is employed separating the oil and air, causing the rotor journal shaft length to be sufficiently increased to accommodate the seals. The increased shaft journal length requires the rotors to be larger and more rigid to manage the shaft forces within an acceptable range of shaft deflection.

In some aspects, embodiments of the present invention eliminate the rolling element bearings in a compressor, and instead employ bushings, e.g., removable bushings, coated with a near-frictionless diamond-like carbon (NFDLC) coating, which are not oil-lubricated. Examples of the NFDLC coatings are described in U.S. Pat. No. 6,548,173 B2, which is incorporated herein by reference. The coating of specific interest is a hydrogenated amorphous carbon film containing both hybrid orbital $sp^2$ and spa carbon bonds, forming additional bonding with hydrogen, in a hydrogen rich environment. The hydrogen atom content ranges from 3% to 40%. The hydrogen, at some range of concentration, has its free electrons bond with the sigma bonds (strongest type of covalent chemical bonds) of the surface carbon atoms, allowing the electrical charge to shift away from the film surface. This shift causes a positive charge at the film surface. Thus, when two opposing NFDLC coatings come into close contact, a repulsion force is created, causing in whole or in part, near-frictionless interfaces between the opposing NFDLC coatings.

The cavity containing the bearing surfaces is operated and maintained with a self-generating supply of dry nitrogen produced from the compressed air flow generated by the compressor, and in some embodiments, also or alternatively from an external compressed air source. NFDLC coatings are subject to oxidative damage in some situations. The dry nitrogen helps prevent NFDLC oxidation damage, allowing the NFDLC coating to operate with a friction coefficient up to or more than 50 times less than the friction coefficient of Polytetrafluoroethylene (PTFE, e.g., Teflon®) for highly extended periods of time, and without the viscous losses associated with oil-supplied bearings. These bearings can be used with various types of compressors, including contact-cooled (CC) or oil-free (OF) rotary screw compressors, as well as centrifugal compressors, Roots blowers and other types of compressors, and have the additional advantage with OF rotary screw compressors of eliminating the complex oil seal arrangement, and thus allowing shorter shaft journals.

The disclosed invention eliminates the conventional oil lubricated bearings, replacing them with NFDLC coated bushings. As a result, the bearing oil supply is eliminated and replaced with a small supply of dry nitrogen, which is produced from the compressed air flow discharged from compressor 12. The resulting friction of the NFDLC bearing is very low, comparable to or less than that of lubricated rolling element bearings, and the viscosity of the dry nitrogen is orders of magnitude less than that of oil, thus yielding improved compressor efficiency via the use of NFDLC coated bearing bushings. Eliminating the bearing oil flow in oil-free rotary screw compressors also eliminates the need for an arrangement of air-oil seals. Eliminating the seal arrangement allows for shorter screw rotor journals and shaft length, thus reducing some material and associated cost in both housings and rotors. More importantly, it allows for a more rigid shaft by reducing the shaft bending moments, thus reduced shaft deflections. Less shaft deflection results in better rotor inter-lobe, meshing and rotor-housing clearance control, providing the opportunity for less compressed air leakage losses.

A compressor employing NFDLC coated bearings thus improves machine efficiency by reducing bearing friction and eliminating oil lubricated bearing viscous losses. Some embodiments employ process-generated dry nitrogen supplied to the bearing cavities to minimize or eliminate coating oxidation, benefiting coating life, and providing surface heat removal of the bearing surfaces. Further benefits are realized with oil-free applications by eliminating the bearing oil flow, thus eliminating the opportunity of bearing oil contamination into the compressed air stream; and eliminating the air-oil shaft seal arrangements, thus reducing each shaft length, resulting in lower shaft deflections and less air leakage, and providing improved machine efficiency.

Purge gas system 26 is in fluid communication with bearing cavities 14 and 16. Purge gas system 26 is constructed to provide a purge gas, and to purge air from bearing cavities 14 and 16, and to supply bearing cavities 14 and 16 with the purge gas. The purge gas is configured in gas type and in concentration to reduce or eliminate oxidation damage to the NFDLC coating, e.g., oxidation due to the presence of a sufficient amount of oxygen near the NFDLC coating to react with the NFDLC coating.

The purge gas is generated and supplied using air compressed by compressor 12 during operation of compressor. In some embodiments, the purge gas is generated and supplied using external compressed air system 28, e.g., when compressor 12 is not running. In other embodiments, the purge gas may be generated and supplied based on external compressed air system 28 when compressor 12 is running. Thus, in various embodiments, the purge gas may be generated and supplied to bearing cavities 14 and 16 while compressor 12 is running, and in some embodiments, while compressor 12 is not running. In one form, the purge gas is nitrogen. In some embodiments, the nitrogen is a dry nitrogen, e.g., nitrogen having water and/or water vapor reduced (e.g., relative to the percentage amount of water or water vapor in the stream discharged from compressor 12) or eliminated therefrom. In a particular form, the purge gas has a nitrogen content greater than that of ambient atmospheric air. In some embodiments, the purge gas may be substantially pure nitrogen. In some embodiments, the purge gas is at least 90% nitrogen. In other embodiments, the purge gas is at least 95% nitrogen. In still other embodiments, the purge gas is at least 99% nitrogen. In yet other embodiments, the purge gas is at least 99.5% nitrogen. In yet still other embodiments, the purge gas is at least 99.9% nitrogen.

Figure 2:
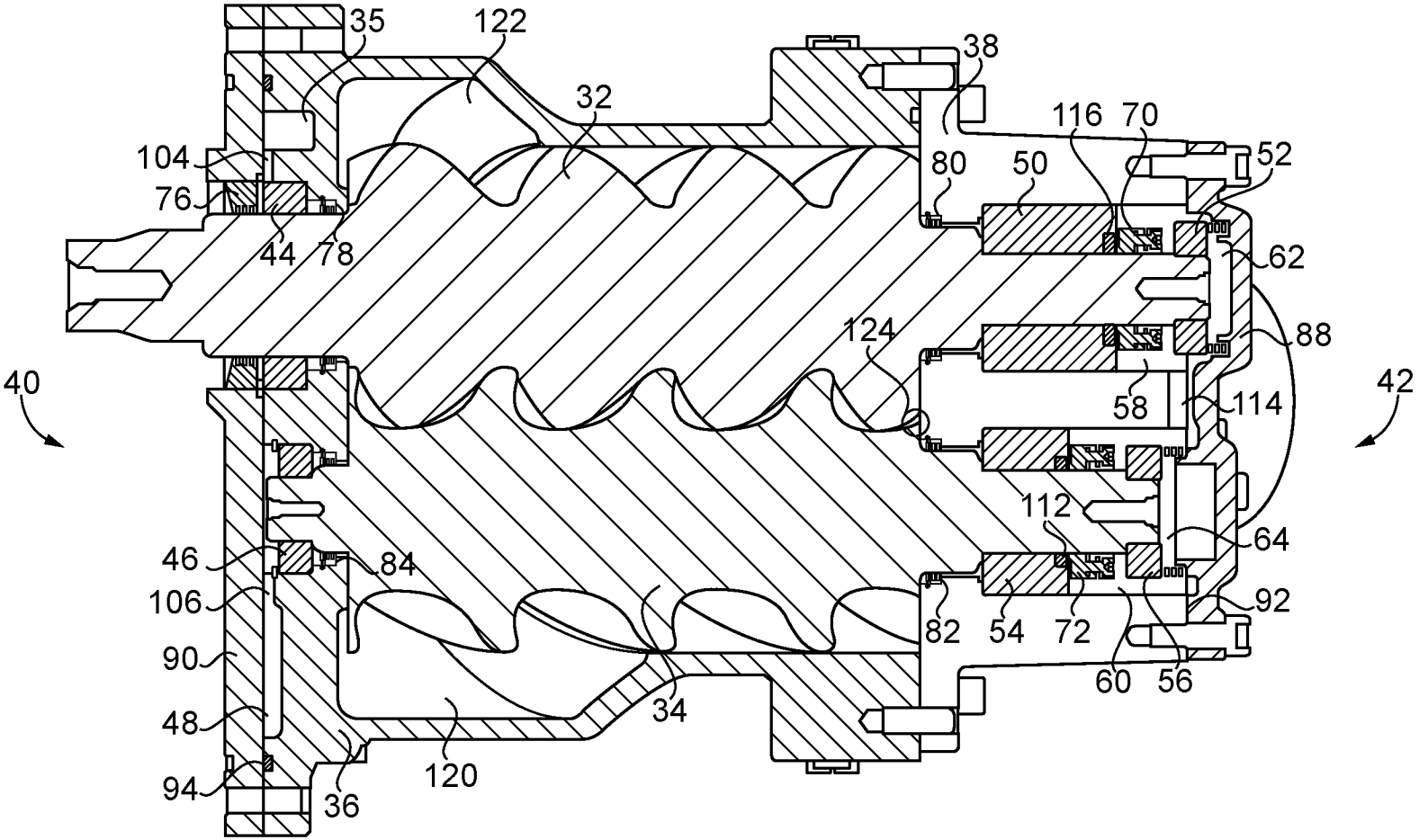
FIG. 2 illustrates some aspects of a non-limiting example of a compressor in accordance with an embodiment of the present invention.

Referring to FIG. 2, some aspects of a non-limiting example of compressor 12 are illustrated in accordance with an embodiment of the present invention. Compressor 12 includes rotors 32, 34 disposed within housings 36, 38. Compressor 12 includes an inlet end 40 and a discharge end 42. On inlet end 40 of compressor 12, rotors 32, 34 are supported by bearing bushings 44, 46, which are disposed in an inlet end bearing cavity 48. On a discharge end 42 of compressor 12, rotors 32, 34 are supported by bearing bushings 50, 52, 54 and 56, which are disposed in discharge end bearing cavities 58, 60. The bearing surfaces of bearing bushings 44, 46, 50, 52, 54 and 56 are coated with the NFDLC coating.

Bearings bushings 44, 46 provide radial support to the male rotor 32 and female rotor 34, respectively. Bearings 52, 56 in combination with wave springs 62, 64 provide reverse thrust axial support to the male and female rotors 32, 34, respectively. Bearings 50, 54 provide both radial and axial support to the rotors 32, 34, respectively. Male and female rotor 32, 34 axial thrust loads are supported the combination of bearings 50, 54, thrust washers 116, 112, and lock nuts 70, 72.

Bearing cavities 48, 58 and 60 receive a small flow of dry nitrogen supplied by purge gas system 26 to purge air from the bearing cavities, and to prevent the ingress of air into the cavities after they are purged. Compressor 12 includes a plurality of shaft seals 76, 78, 80, 82, 84, covers 88, 90 and gland seals 92, 94, which are constructed to contain the supplied nitrogen within inlet and discharge bearing cavities 48, 58, 60.

Figure 3:
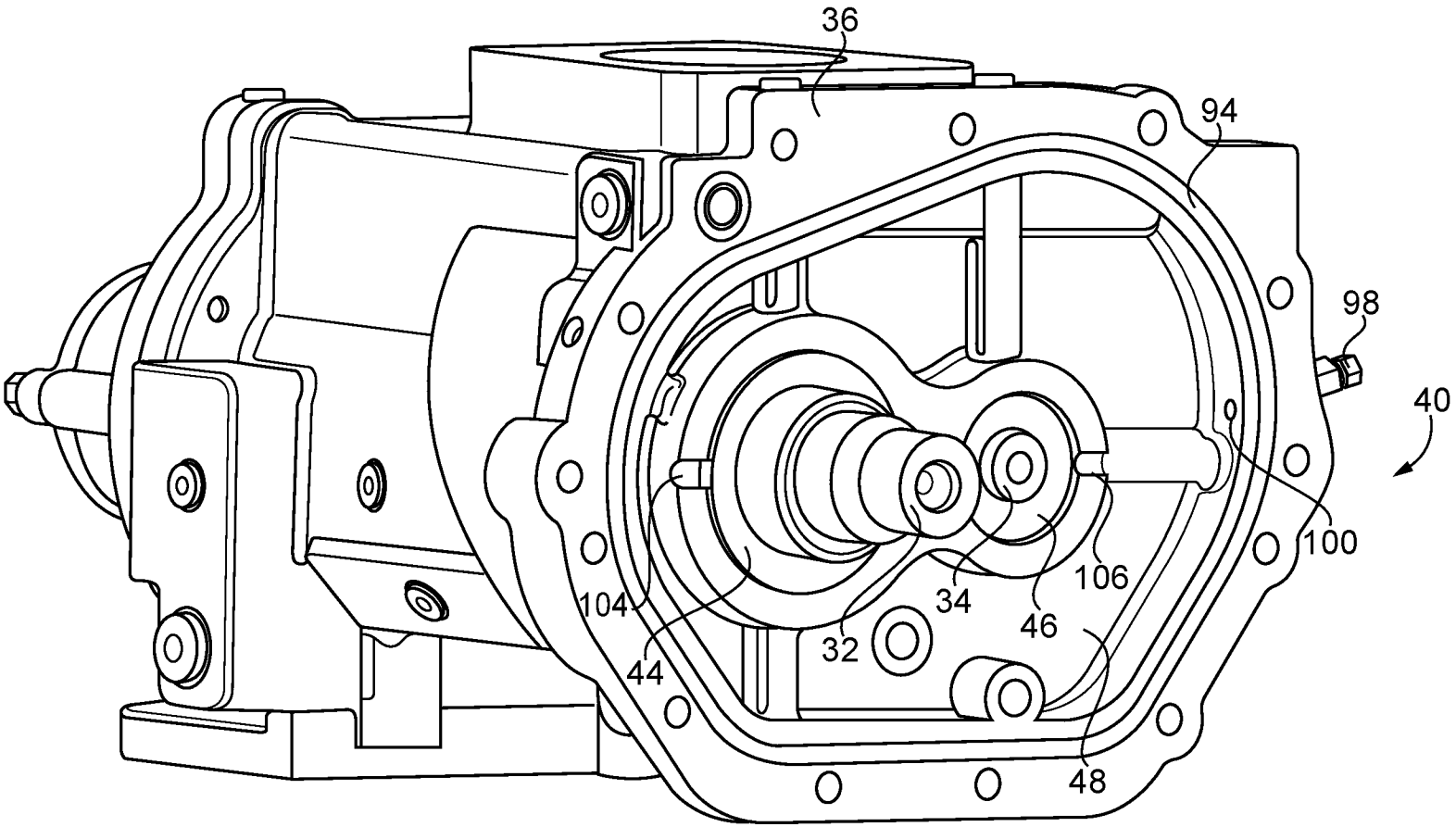
FIG. 3 illustrates a perspective view taken from an inlet end of the compressor of FIG. 2 illustrating some aspects of the compressor in accordance with an embodiment of the present invention.
Figure 4:
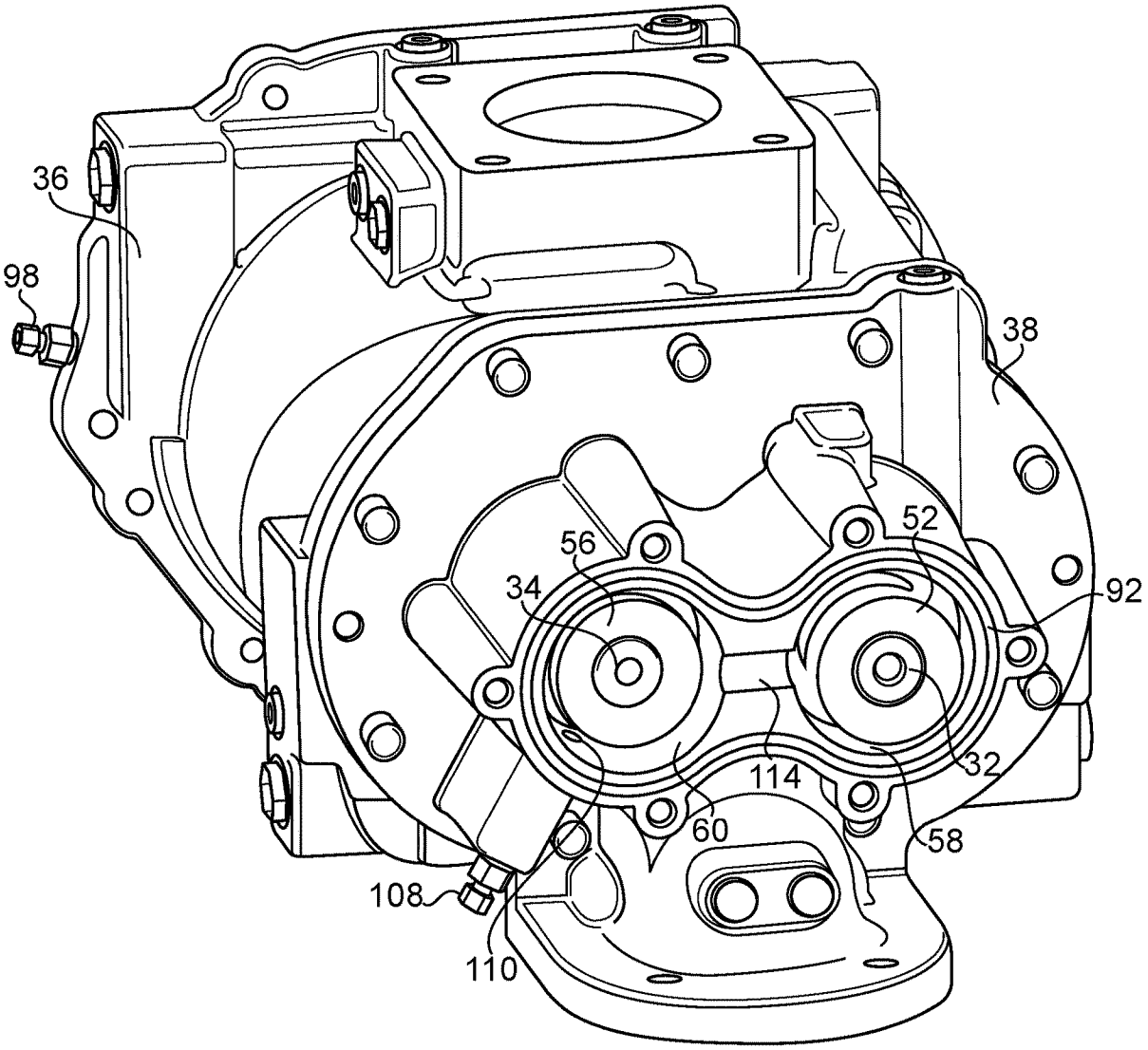
FIG. 4 illustrates a perspective view taken from a discharge end of the compressor of FIG. 2 illustrating some aspects of the compressor in accordance with an embodiment of the present invention.

Referring also to FIGS. 3 and 4, some aspects of a non-limiting example of compressor 12 are illustrated in accordance with an embodiment of the present invention. In the depictions of FIGS. 3 and 4, certain components are removed for clarity of illustration. FIG. 3 provides a front perspective view of inlet end 40 of compressor 12 with cover 90, shaft seal 76 and associated retaining clips removed. Low-pressure dry nitrogen feed from purge gas system 26 is supplied via a fitting 98 attached to rotor housing 36, communicating nitrogen through a bore 100 into the inlet bearing cavity 48. The low-pressure nitrogen is supplied at a pressure slightly higher than the inlet pressure of compressor 12, e.g., 0.5-1.0 psi higher than the inlet pressure. In other embodiments, other pressure values may be employed. Nitrogen flows from inlet bearing cavity 48 through a feed slot 104 to the male inlet bearing bushing 44, and similarly through feed slot 106 to the female inlet bearing bushing 46.

FIG. 4 provides a back perspective view showing the discharge end 42 of the compressor 12 with cover 88 and wave springs 62, 64 removed. High-pressure dry nitrogen feed is supplied at a fitting 108 attached to rear bearing housing 38, communicating nitrogen through a bore 110 into the bearing cavity 60. The high-pressure nitrogen is slightly higher than the discharge pressure of compressor 12, e.g., 0.5-1.0 psi higher than the discharge pressure. In other embodiments, other pressure values may be employed. Nitrogen flows to female rotor discharge bearings 54, 56 and thrust washer 112, while separately flowing through feed slot 114 to the male rotor discharge bearings 52, 50 and thrust washer 116.

Bearing cavities 48, 58, 60 are pressurized just slightly higher than the pressure in the immediately adjacent compressor sections 120, 122, 124, e.g., 0.5-1.0 psi, which are separated by shaft seals 78, 80, 82, 84. This allows a driving force for very small flows of dry nitrogen gas to leak past rotor inlet seals 76, 78, 84 and similarly rotor discharge seals 80, 82. This flow ensures oxygenated air does not enter the bearing cavities 48, 58, 60, contacting and potentially oxidizing the NFDLC coatings, and additionally removes a small amount of heat to maintain steady-state operating temperatures at the coating surfaces.

Figure 5:
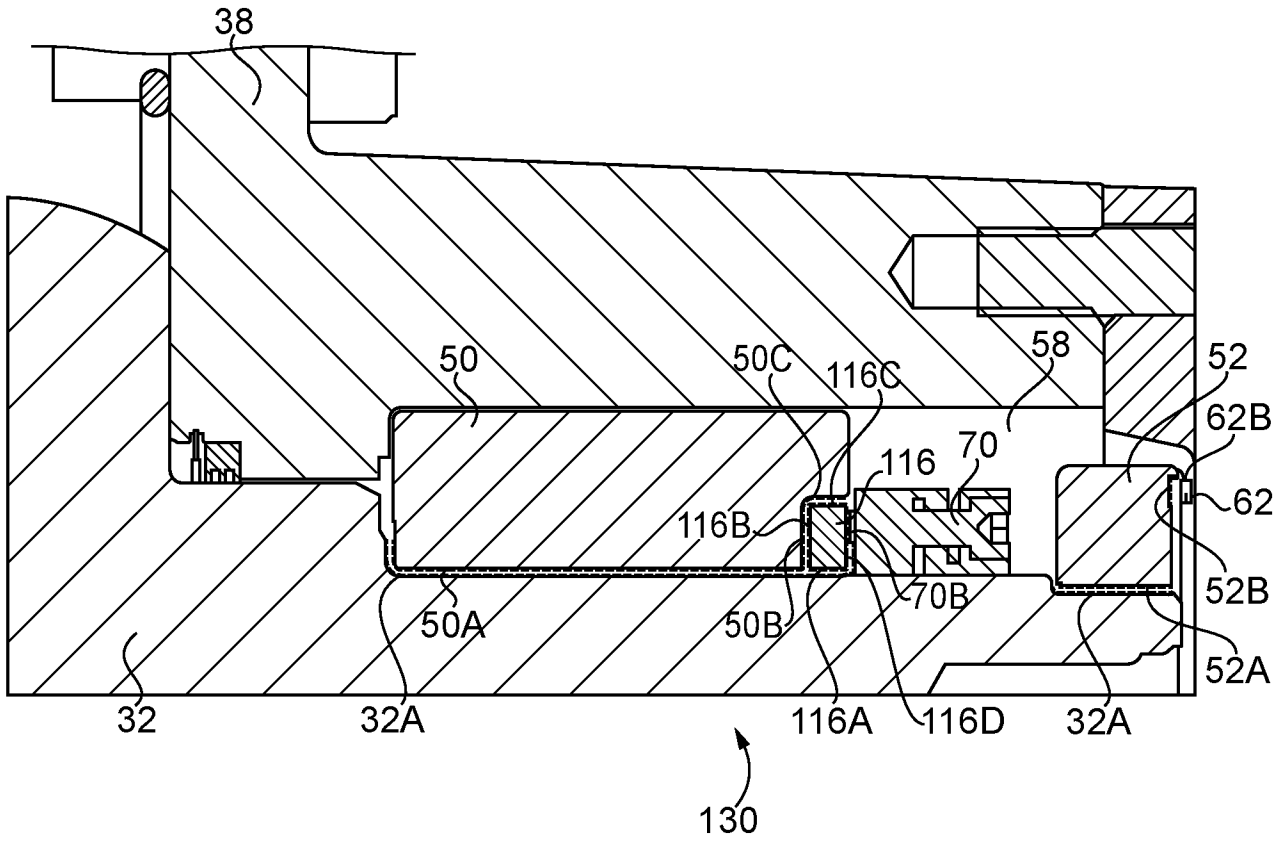
FIG. 5 illustrates some aspects of a non-limiting example of bearing bushings in a bearing cavity in accordance with an embodiment of the present invention.

Referring also to FIG. 5, some aspects of a non-limiting example of a close up view of the male rotor discharge end bearing cavity 58 are illustrated in accordance with an embodiment of the present invention. The NFDLC coating, identified as NFDLC coating 130 in FIG. 5, is applied to all opposing bearing surfaces. The application of the NFDLC coating in bearing cavity 58 and the bearing surfaces contained therein is similar to the application of the NFDLC coating in the balance of bearing cavities and bearing surfaces in compressor 12 insofar as the description relates to the use of NFDLC coating 130. The view of FIG. 5 is provided as an example for compressor 12 bearing surfaces.

In the embodiment of FIG. 5, bearing bushing 50 is press fit into housing 38, causing bearing bushing 50 to be stationary. Dashed lines in FIG. 5 represent NFDLC coating 130 on the following indicated surfaces. Rotor 32 is coated with NFDLC coating 130 at its bearing journal surface 32A. Bearing bushing 50 is coated with NFDLC coating 130 at its adjacent face 50A and along its surface 50B where it is adjacent to the coated thrust washer face 116B. The thrust washer 116 is coated with NFDLC coating 130 on all surfaces 116A, 116B, 116C and 116D, including the surface adjacent to lock nut 70, which is coated with NFDLC coating 130 at its face 70B, providing near-frictionless axial thrust surfaces. Similarly, the reverse thrust bearing 52 is coated with NFDLC coating 130 on its surfaces 52A and 52B adjacent to the respective rotor surface 32A (which is also coated with NFDLC coating 130) and wave spring surface 62B, which is also coated with NFDLC coating 130. In some embodiments, to provide some misalignment tolerance between each shaft and each radial bearing, a small amount of surface crowning can be included to the shaft and/or bearing bore.

Figure 6:
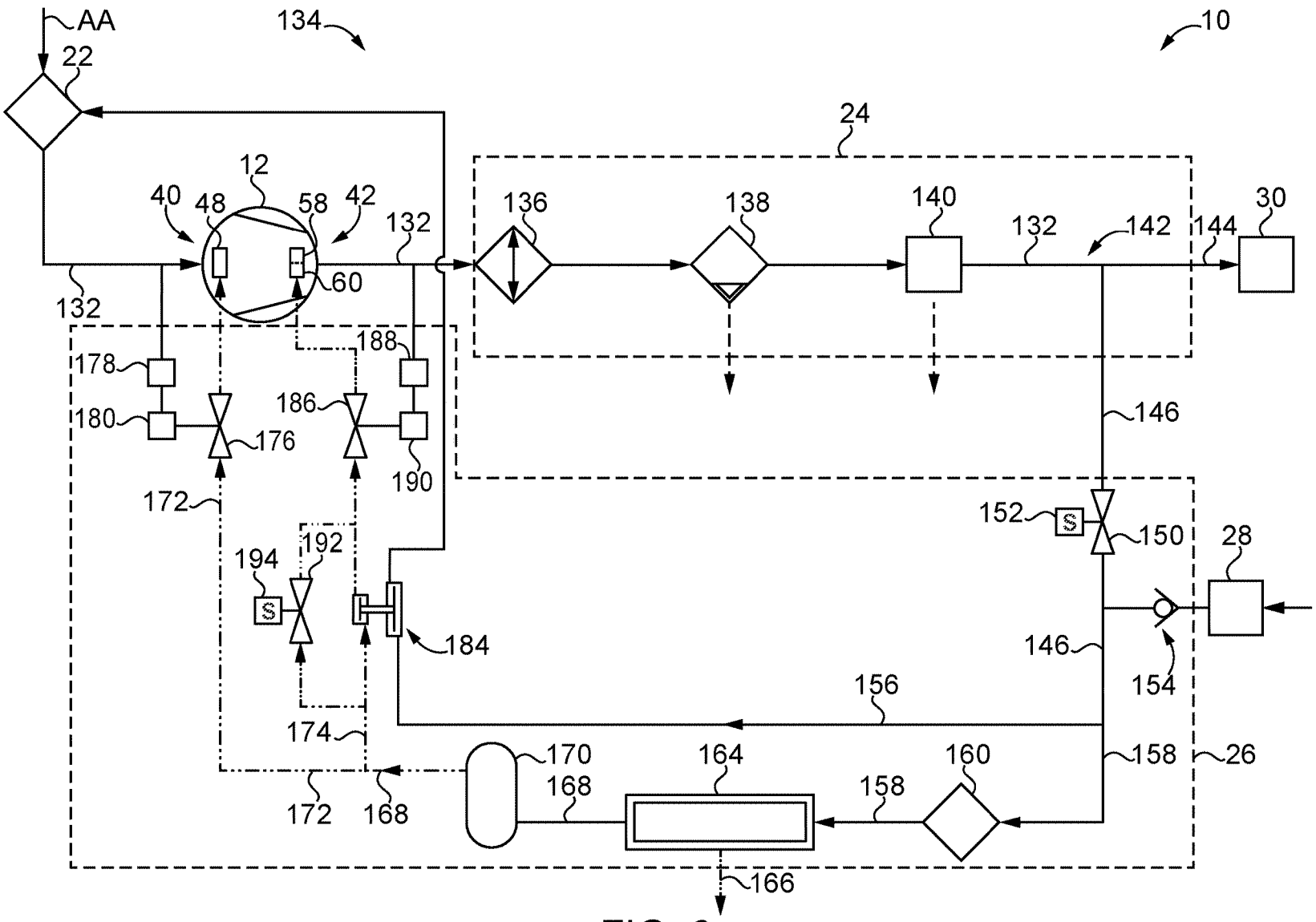
FIG. 6 schematically illustrates some aspects of a non-limiting example of a compressor system in accordance with an embodiment of the present invention.

Referring also to FIG. 6, a system diagram 134 illustrates the some of the relationships of the components of compressor system 10. During operation, ambient air AA enters particulate filter 22, which is constructed to remove a predetermined level of particulate contaminants prior to entry of the air into compressor 12. The air exits filter 22 as a primary flow stream 132 and is directed to the inlet of compressor 12. Compressor 12 contains the NFDLC coated bearing system previously described, and receives the pre-filtered air, compresses it and discharges it into conditioning system 24.

Conditioning system 24 includes a heat exchanger 136, an air-water separator 138 and a dryer 140. Heat exchanger 136 is constructed to cool the compressed air, e.g., using ambient air, water or another heat exchange medium as a heat sink. By cooling the compressed air, heat exchanger 136 removes water from the air in some embodiments and/or operating conditions by condensing the water from the air. Air-water separator 138 is constructed to remove liquid water from the air discharged by heat exchanger 136, and delivers the air to dryer 140. Dryer 140 is operative to constructed to remove moisture, water, and in some embodiments, water vapor from the compressed air. Dryer 140 may be any conventional dryer, e.g., may be a refrigerated dryer, a desiccant dryer and/or another type of compressed air dryer.

During operation, compressed air enters heat exchanger 136 and is cooled. After exiting heat exchanger 136, the cooled compressed air likely contains some condensed water, which enters and is removed by an air-water separator 138. The separated water is discharged outside compressor system 10, while the compressed air stream continues to dryer 140. Dryer 140 may be of any suitable type to further reduce the pressure-dew point of the air stream, with removed moisture being discharged outside of the system 10.

At a branch 142 downstream of dryer 140, primary stream 132 divides into a second stream 144 and a third stream 146. The second stream 144 represents most of the compressed dried primary flow stream 132, and continues outside of system 10 for use in end user or customer device or process 30. Third stream 146 is directed into purge gas system 26.

Purge gas system 26 is in fluid communication with the bearing cavities, e.g., bearing cavities 48, 58 and 60. Purge gas system 26 is constructed to prevent or reduce oxidation of the NFDLC coating by purging air from the bearing cavities and by supplying the bearing cavities with purge gas to reduce or eliminate the presence of oxygen in the bearing cavities and, and to prevent ingress of air into the bearing cavities 48, 58 and 60. Purge gas system 26 includes an isolation valve 150 operated by a solenoid (S) 152; a valve 154; a filter system 160; a nitrogen generator 164; a nitrogen storage tank 170; a control valve 176; a pressure sensor 178 communicatively coupled to a valve controller 180 constructed to control the control valve 176; a gas amplifier 184 (also known as a gas pressure amplifier, an air amplifier and an air pressure amplifier) constructed to amplify the pressure of the purge gas received thereinto; a control valve 186; a pressure sensor 188; a valve controller 190; a bypass valve 192; and a solenoid (S) 194 for operating bypass valve 192.

The third stream 146 is formed of a very small amount of the compressed dried primary flow stream 132. The flow of third stream 146 is controlled by isolation valve 150, which in the illustrated embodiment is a solenoid valve. In other embodiments, isolation valve 150 may, for example, be a check valve, an orifice, a metering valve or any other suitable type of valve. In the illustration of FIG. 6, isolation valve 150 is a solenoid valve.

Isolation valve 150 provides third stream 146 compressed air flow to purge gas system 26, which in the illustrated embodiment is a dry nitrogen system. The term, "dry" is used because the purge gas generated by purge gas system 26 is dry, e.g., having been dried by conditioning system 24, and in some embodiments, additional water removal filters and/or dryers and/or other water/moisture/water vapor removal devices included in one or more embodiments of the present invention. Dry nitrogen is thus nitrogen with a reduced water and/or water vapor content relative to that of ambient air, e.g., the ambient air supplied to compressor 12, or relative to the compressed air discharged by compressor 12. In some embodiments, the dry nitrogen has substantially all of the water and/or water vapor removed therefrom. In the illustrated embodiment, the purge gas is provided from purge gas system 26 in the form of predominately nitrogen, e.g., as discussed above.

In some embodiments, solenoid 152 is operative to close isolation valve 150 when compressor 12 is not running, during which time compressed air is supplied to purge gas system 26 by external compressed air source 28. When compressor 12 is running, e.g., after having achieved a discharge pressure above a desired discharge pressure value, isolation valve 150 is opened by solenoid 152, directing compressed air from compressor 12 into purge gas system 26. Backflow into external compressed air system 28 is prevented by check valve 154.

During the operation of compressor system 10, third stream 146 is supplied via compressor 12 and conditioning system 24 to purge gas system 26 in order to generate the nitrogen purge gas. When compressor 12 is not operating, external compressed air system 28 supplies dry, compressed air to purge gas system 26 in order to generate the nitrogen purge gas. A valve 154 may control the flow of dry, compressed air from external compressed air system 28 to purge gas system 26. In one form, valve 154 is a check valve. In other embodiments, valve 154 may be another type of valve.

In some embodiments, solenoid 152 is operative to close isolation valve 150 when compressor 12 is not running, during which time compressed air is supplied to purge gas system 26 by external compressed air source 28. When compressor 12 is running, e.g., after having achieved a discharge pressure above a desired discharge pressure value, isolation valve 150 is opened by solenoid 152, directing compressed air from compressor 12 into purge gas system 26. Backflow into external compressed air system 28 is prevented by check valve 154. Thus, in some embodiments, bearing cavities 48, 58 and 60 are purged with the purge gas, and continually supplied with the purge gas while operating compressor 12, and also when compressor 12 is not running or operating.

Downstream of isolation valve 150, the third stream 146 is further divided into a fourth stream 156 to provide working energy and a fifth stream 158 to generate the dry nitrogen purge gas. The fifth stream 158 of compressed air is routed to a filter system 160 that may be a combination of particulate, charcoal, and fine particulate filters. Filter system 160 may include additional filters such as for further water removal, trace corrosive chemical filtration, or other contaminants as required. The filtered air continues to a nitrogen generator 164. Nitrogen generator 164 is constructed to generate the purge gas from air. In particular, nitrogen generator 164 is in fluid communication with compressor 12 and with external air compressed air system 28. Nitrogen generator is constructed to generate the purge gas, e.g., nitrogen, from compressed air received from compressor 12 while compressor 12 is running, and from compressed air received from external air compressed air system 28 when compressor 12 is not running, thus providing purge gas to the bearing cavities 48, 58 and 60 whether or not compressor 12 is running.

In one form, nitrogen generator 164 employs a nitrogen separation membrane to separate nitrogen from air. In other embodiments, other forms of nitrogen separation devices may be employed. In nitrogen generator 164, the fifth stream 158 is divided into a sixth stream 166 of separated molecular oxygen (and in some embodiments, other constituents removed from the compressed air), and a seventh stream 168 of separated molecular nitrogen. The molecular oxygen (and in some embodiments, the other constituents removed from the compressed air) is exhausted outside of the purge gas system 26, while the nitrogen of the seventh stream 168 continues to a nitrogen storage tank 170. Nitrogen storage tank 170 is in fluid communication with the bearing cavities, e.g., bearing cavities 48, 58 and 60. The flow of nitrogen purge gas is indicated in FIG. 6 as a double-dot dashed line.

The seventh stream 168 is formed of molecular nitrogen, or dry nitrogen, and is further divided into an eighth stream 172 and ninth stream 174. Eighth stream 172 is the purge gas supplied to inlet end bearing cavity 48, whereas ninth stream 174 is the purge gas supplied to discharge end bearing cavities 58, 60. The eighth stream 172 enters a control valve 176 that functions to reduce dry nitrogen pressure to a value just slightly greater than that of the compressor inlet pressure, e.g., as described above. Control valve 176 is constructed to reduce the pressure of the purge gas prior to entry of the purge gas into the bearing cavity 48 disposed at the inlet end 40 of compressor 12. A pressure sensor 178 is in fluid communication with the inlet end 40 of compressor 12, and is communicatively coupled to a valve controller 180. Pressure sensor 178 provides a signal indicative of the inlet pressure of compressor 12. Valve controller 180 controls the control valve 176 to regulate the pressure of the purge gas to achieve a desired pressure and flow rate of the purge gas of eighth stream 172 into bearing cavity 48. This pressure differential, as described above, is used to maintain a positive pressure inside the inlet bearing cavity 48, ensuring the NFDLC coatings remain in an oxygen-free environment. In some embodiments, the inlet end bearing cavity 48 may be maintained in a reduced oxygen environment.

In one form, gas amplifier 184 is constructed to increase the pressure of the purge gas to being above the discharge pressure of compressor 12. In some embodiments, e.g., where the discharge end bearing cavity 58, 60 pressure is below the discharge pressure of compressor 12, gas amplifier 184 may be constructed to increase the pressure of the purge gas to being above the discharge end 42 bearing cavity 58, 60 pressure. During compressor operation, the ninth stream 174 enters gas amplifier 184, which increases the dry nitrogen pressure, e.g., as mentioned above. The boosted pressurized purge gas stream is received into a control valve 186, which functions to deliver the purge gas, e.g., dry nitrogen, to bearing cavities 58, 60 at the elevated pressure.

A pressure sensor 188 is in fluid communication with the discharge end 42 compressor 12, and is communicatively coupled to a valve controller 190. Pressure sensor 188 provides a signal indicative of the discharge pressure of compressor 12.

Valve controller 190 controls the control valve 186 to regulate the pressure of the purge gas to achieve a desired pressure and flow rate of the purge gas into discharge end bearing cavities 58 and 60. This pressure differential, as described above, maintains a positive pressure inside the discharge end bearing cavities 58 and 60, ensuring the NFDLC coatings remain in an oxygen-free environment in some embodiments, or a reduced oxygen environment in other embodiments. When the compressor 12 is not running, a bypass valve 192 opens, allowing the ninth stream 174, supplied by external compressed air system 28, to flow directly to control valve 186 to maintain the appropriate bearing cavity pressure. In one form, bypass valve 192 is a solenoid valve operated by a solenoid 194. In other embodiments, bypass valve 192 may take other forms.

In one form, compressed gas amplifier 184 is pneumatically powered by the compressed air of fourth stream 156. In other embodiments, compressed gas amplifier 184 may be powered by other power sources. In one form, compressed gas amplifier 184 is a piston device. In other embodiments, gas amplifier 184 may be one or more various types of compressors. In the illustrated embodiment, fourth stream 156 of compressed air is provided to the working side of the compressed gas amplifier 184, and provides the energy or power to gas amplifier 184 to increase the pressure of the ninth stream 174 dry nitrogen. The compressed air from fourth stream 156 is then exhausted. In the illustrated embodiment, the exhausted air stream is supplied to the compressor 12 inlet, since the exhausted air stream has had some level of particulate and water contamination removed, thus providing a higher level of air quality to the compressor inlet.

Embodiments of the present invention include a compressor system, comprising: a compressor having a rotor; a bearing supporting the rotor, wherein the bearing is disposed in a bearing cavity; and wherein the bearing has a near frictionless coating; and a purge gas system in fluid communication with the bearing cavity and constructed to purge air from the bearing cavity and supply the bearing cavity with the purge gas during operation of the compressor, wherein the purge gas is at least 90% nitrogen.

In a refinement, the purge gas system includes a purge gas storage tank in fluid communication with the bearing cavity.

In another refinement, the purge gas includes nitrogen; further comprising a nitrogen generator constructed to generate the purge gas from air, wherein the purge gas is at least 95% nitrogen.

In yet another refinement, the purge gas is at least 99% nitrogen.

In still another refinement, the nitrogen generator is in fluid communication with the compressor and constructed to generate the nitrogen from compressed air received from the compressor.

In yet still another refinement, the compressor system further comprises means for reducing or eliminating water and/or water vapor from the compressed air prior to delivery of the compressed air to the nitrogen generator, wherein the nitrogen discharged from the nitrogen generator is dry nitrogen.

In a further refinement, the compressor includes a discharge end; wherein the wherein the bearing cavity is disposed at the discharge end, further comprising a gas amplifier constructed to increase the pressure of the purge gas to being above a discharge pressure of the compressor.

In a yet further refinement, the compressor includes an inlet end; wherein the wherein the bearing cavity is disposed at the inlet end, further comprising a valve constructed to reduce the pressure of the purge gas prior to entry of the purge gas into the bearing cavity.

Embodiments of the present invention include a compressor system, comprising: a compressor having a component, the component having a coating and being disposed in a cavity; and a purge gas system in fluid communication with the cavity, the purge gas system being constructed to prevent or reduce oxidation of the coating, the purge gas system having a nitrogen generator constructed to generate a purge gas, the purge gas having a nitrogen content greater than that of ambient air, the purge gas system being constructed to purge air from the cavity and supply the cavity with the purge gas and prevent the ingress of air into the cavity.

In a refinement, the purge gas system includes a nitrogen storage tank in fluid communication with the cavity.

In another refinement, the purge gas is at least 95% nitrogen.

In yet another refinement, the purge gas is at least 99% nitrogen.

In still another refinement, the nitrogen generator is in fluid communication with the compressor and constructed to generate the purge gas from compressed air received from the compressor.

In yet still another refinement, the compressor system further comprises 14. The compressor system of claim 13, further comprising means for removing water and/or water vapor from the compressed air prior to delivery of the compressed air to the nitrogen generator, wherein the nitrogen generated by the nitrogen generator is dry nitrogen.

In a further refinement, the method further comprises an external compressed air source, wherein the nitrogen generator is in fluid communication with the external compressed air source and constructed to receive compressed air from the external compressed air source; and wherein the nitrogen generator is constructed to generate the purge gas from the compressed air received from the external compressed air source when the compressor is not running.

In a yet further refinement, the compressor includes a discharge end; wherein the wherein the cavity is disposed at the discharge end, further comprising a gas amplifier constructed to increase the pressure of the purge gas.

Embodiments of the present invention include a method of operating a compressor, comprising: purging a bearing cavity of air with a purge gas; continuing to supply the purge gas to the bearing cavity; operating the compressor while supplying the purge gas to the bearing cavity.

In a refinement, the method further comprises supplying compressed air to a nitrogen generator to generate the purge gas using the nitrogen generator, wherein the purge gas has a nitrogen content of at least 95%.

In yet another refinement, the method further comprises drying the compressed air prior to generating the purge gas, and supplying the purge gas to the bearing cavity as a dry purge gas.

In still another refinement, the method further comprises increasing the pressure of the purge gas using a gas amplifier powered by the compressed air.

Embodiments of the present invention include a system operative to flow a working fluid, comprising: a bearing system disposed in a bearing cavity, the bearing system having a first surface that moves relative to a second surface, the first and second surfaces having a near frictionless diamond-like carbon (NFDLC) coating, the coating constructed to cause the first and second surfaces to repel each other; and a purge gas system in fluid communication with the bearing cavity and constructed to generate a purge gas from the working fluid, the purge gas being compositionally different than the working fluid, the purge gas system being constructed to purge the bearing cavity and supply the bearing cavity with the purge gas during operation of the system, wherein the purge gas has a nitrogen content greater than that of the working fluid.

In a refinement, the purge gas system includes a purge gas storage tank in fluid communication with the bearing cavity.

In another refinement, the working fluid is air, and the purge gas includes nitrogen; further comprising a nitrogen generator constructed to generate the purge gas from the air.

In yet another refinement, the system includes a compressor having a rotor operative to compress air as the working fluid, the nitrogen generator being in fluid communication with the compressor and constructed to generate the nitrogen from compressed air received from the compressor.

In still another refinement, the system further comprising an air-water separator and/or a dryer for reducing or eliminating water and/or water vapor from the compressed air prior to delivery of the compressed air to the nitrogen generator, wherein the nitrogen discharged from the nitrogen generator is dry nitrogen.

In yet still another refinement, the compressor includes a discharge end, the bearing cavity being disposed at the discharge end, further comprising a gas amplifier constructed to increase the pressure of the purge gas to being above a discharge pressure of the compressor.

In a further refinement, the gas amplifier is a mechanical gas amplifier.

In a yet further refinement, the compressor includes an inlet end, the bearing cavity being disposed at the inlet end, further comprising a valve constructed to reduce the pressure of the purge gas prior to entry of the purge gas into the bearing cavity.

Embodiments of the present invention include a compressor system operative to compress a working fluid, comprising: a compressor having a component, the component having a coating and being disposed in a cavity; and a purge gas system in fluid communication with the cavity, the purge gas system being constructed to discourage oxidation of the coating, the purge gas system having a nitrogen generator constructed to generate a purge gas from the working fluid and having a different composition than the working fluid, the purge gas having a nitrogen content greater than that of the working fluid, the purge gas system being constructed to purge the cavity and supply the cavity with the purge gas and prevent the ingress of another gas into the cavity.

In a refinement, the purge gas system includes a nitrogen storage tank in fluid communication with the cavity.

In another refinement, the working fluid is air; and the nitrogen generator is in fluid communication with the compressor and constructed to generate the purge gas from compressed air received from the compressor.

In yet another refinement, a flow of the purge gas is substantially less than a flow of the working fluid.

In another refinement, the compressor system further comprises an air-water separator and/or a dryer for reducing or eliminating water and/or water vapor from the compressed air prior to delivery of the compressed air to the nitrogen generator, wherein the nitrogen generated by the nitrogen generator is dry nitrogen.

In yet another refinement, the compressor system further comprises an external compressed air source, wherein the nitrogen generator is in fluid communication with the external compressed air source and constructed to receive compressed air from the external compressed air source; and wherein the nitrogen generator is constructed to generate the purge gas from the compressed air received from the external compressed air source and to purge the cavity with the purge gas when the compressor is not running.

In still another refinement, the compressor includes a discharge end; and the cavity is disposed at the discharge end, further comprising a gas amplifier constructed to increase the pressure of the purge gas.

In yet another refinement, the gas amplifier is a mechanical gas amplifier.

In yet still another refinement, the gas amplifier is coupled to the discharge end of the compressor and is constructed to increase the pressure of the purge gas using the pressure of compressed working fluid discharged by the compressor.

Embodiments of the present invention include a method of operating a compressor, comprising: purging a bearing cavity of air with a purge gas; continuing to supply the purge gas to the bearing cavity; and operating the compressor while supplying the purge gas to the bearing cavity.

In a refinement, the method further comprises supplying compressed air to a nitrogen generator to generate the purge gas using the nitrogen generator, wherein the purge gas has a nitrogen content of at least 95%.

In another refinement, the method further comprises drying the compressed air prior to generating the purge gas, and supplying the purge gas to the bearing cavity as a dry purge gas.

In yet another refinement, the method further comprises increasing the pressure of the purge gas using a gas amplifier powered by the compressed air.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

What is claimed is:

1. A system operative to flow a working fluid, comprising:

a compressor comprising a rotor, wherein the rotor is supported by a bearing in a bearing cavity;

the compressor rotor having a first surface that moves relative to a second surface of the bearing, the first surface and the second surface having a near frictionless diamond-like carbon (NFDLC) coating, the near frictionless diamond-like carbon coating constructed to cause the first surface and the second surface to repel each other; and a purge gas system in fluid communication with the bearing cavity and constructed to generate a purge gas from the working fluid, the purge gas being compositionally different than the working fluid, the purge gas system being constructed to purge the bearing cavity and supply the bearing cavity with the purge gas during operation of the system, wherein the purge gas has a nitrogen content greater than that of the working fluid.

2. The system of claim 1, wherein the purge gas system includes a purge gas storage tank in fluid communication with the bearing cavity.

3. The system of claim 2, wherein the working fluid is air, and wherein the purge gas includes nitrogen; further comprising a nitrogen generator constructed to generate the purge gas from the air.

4. The system of claim 3, wherein the compressor rotor is rotated to compress air as the working fluid, the nitrogen generator being in fluid communication with the compressor and constructed to generate the nitrogen from compressed air received from the compressor.

5. The system of claim 4 further comprising an air-water separator and/or a dryer for reducing or eliminating water and/or water vapor from the compressed air prior to delivery of the compressed air to the nitrogen generator, wherein the nitrogen discharged from the nitrogen generator is dry nitrogen.

6. The system of claim 4, wherein the compressor includes a discharge end, the bearing cavity being disposed at the discharge end, further comprising a gas amplifier constructed to increase the pressure of the purge gas to being above a discharge pressure of the compressor.

7. The system of claim 6, wherein the gas amplifier is a mechanical gas amplifier.

8. The system of claim 4, wherein the compressor includes an inlet end, the bearing cavity being disposed at the inlet end, further comprising a valve constructed to reduce the pressure of the purge gas prior to entry of the purge gas into the bearing cavity.

9. A compressor system operative to compress a working fluid, comprising:

a compressor having a rotor with a first surface supported by a bearing having a second surface which faces the first surface, the first surface and the second surface each having a near frictionless diamond-like carbon coating and being disposed in a cavity, where the near frictionless diamond-like carbon coating is constructed to cause the first surface and the second surface to repel each other; and a purge gas system in fluid communication with the cavity, the purge gas system being constructed to discourage oxidation of the near frictionless diamond-like carbon coating, the purge gas system having a nitrogen generator constructed to generate a purge gas from the working fluid and having a different composition than the working fluid, the purge gas having a nitrogen content greater than that of the working fluid, the purge gas system being constructed to purge the cavity and supply the cavity with the purge gas, such that the purge gas flows from the cavity to the rotor to prevent the ingress of the working fluid into the cavity.

10. The compressor system of claim 9, wherein the purge gas system includes a nitrogen storage tank in fluid communication with the cavity.

11. The compressor system of claim 9, wherein the working fluid is air; and wherein the nitrogen generator is in fluid communication with the compressor and constructed to generate the purge gas from compressed air received from the compressor.

12. The compressor system of claim 11, further comprising an air-water separator and/or a dryer for reducing or eliminating water and/or water vapor from the compressed air prior to delivery of the compressed air to the nitrogen generator, wherein the nitrogen generated by the nitrogen generator is dry nitrogen.

13. The compressor system of claim 11, wherein a flow of the purge gas is substantially less than a flow of the working fluid.

14. The compressor system of claim 9, further comprising an external compressed air source, wherein the nitrogen generator is in fluid communication with the external compressed air source and constructed to receive compressed air from the external compressed air source; and wherein the nitrogen generator is constructed to generate the purge gas from the compressed air received from the external compressed air source and to purge the cavity with the purge gas when the compressor is not running.

15. The compressor system of claim 9, wherein the compressor includes a discharge end, and the cavity is disposed at the discharge end, further comprising a gas amplifier constructed to increase the pressure of the purge gas.

16. The compressor system of claim 15, wherein the gas amplifier is a mechanical gas amplifier.

17. The compressor system of claim 15, wherein the gas amplifier is coupled to the discharge end of the compressor and is constructed to increase the pressure of the purge gas using the pressure of compressed working fluid discharged by the compressor.

18. A method of operating a compressor, comprising:

rotating a rotor of the compressor to compress air;

operating a purge gas system having a nitrogen generator constructed to generate a purge gas from compressed air;

during the rotating, repelling a first surface of the rotor which has a near frictionless diamond-like carbon (NFDLC) coating from a second surface of a bearing which has a near frictionless diamond-like carbon (NFDLC) coating, the bearing being disposed in a bearing cavity of the compressor;

purging the bearing cavity of air with the purge gas to discourage oxidation of the near frictionless diamond-like carbon coatings;

continuing to supply the purge gas to the bearing cavity; and operating the compressor while supplying the purge gas to the bearing cavity, such that the purge gas flows from the bearing cavity to the rotor to prevent the ingress of air into the bearing cavity.

19. The method of claim 18, wherein the purge gas has a nitrogen content of at least 95%.

20. The method of claim 19, further comprising drying the compressed air prior to generating the purge gas, and supplying the purge gas to the bearing cavity as a dry purge gas.

21. The method of claim 19, further comprising increasing the pressure of the purge gas using a gas amplifier powered by the compressed air.

* * * * *